US005213141A

United States Patent [19]

Dorman

[11] Patent Number: 5,213,141

[45] Date of Patent: May 25, 1993

[54] DEBRIS COLLECTION AND DISPOSAL SYSTEM AND METHOD

[76] Inventor: Ira S. Dorman, 607 Spring St., Manchester, Conn. 06040

[21] Appl. No.: 603,997

[22] Filed: Oct. 26, 1990

[51] Int. Cl.[5] ..... B65B 1/04; B65B 67/00

[52] U.S. Cl. ..... 141/10; 141/114; 141/314; 141/319; 141/325; 53/390; 220/908

[58] Field of Search ..... 141/114, 314, 316, 319, 141/325, 10, 315, 391; 383/72, 75, 76; 220/908; 53/390

[56] References Cited

U.S. PATENT DOCUMENTS

| | | | |
|---|---|---|---|
| 1,715,861 | 6/1929 | Owen | 220/908 X |
| 2,092,969 | 9/1937 | Gustafson et al. | 383/103 X |
| 3,094,810 | 6/1963 | Kalpin | 383/103 X |
| 3,546,327 | 12/1970 | Ruda | 383/103 X |
| 3,934,999 | 1/1976 | Meier | 383/103 X |
| 4,020,922 | 5/1977 | Klasel | 383/75 X |
| 4,254,602 | 3/1981 | Boynton | 220/908 X |
| 4,440,321 | 4/1984 | Campbell et al. | 206/815 X |

FOREIGN PATENT DOCUMENTS

| | | | |
|---|---|---|---|
| 2802849 | 7/1978 | Fed. Rep. of Germany | 383/103 |
| 0262625 | 2/1929 | Italy | 141/315 |

*Primary Examiner*—William A. Cuchlinski, Jr.
*Assistant Examiner*—W. Morris Worth

[57] ABSTRACT

A system for collection and transfer of lawn debris consists of a vented collapsible bag and a rigid container, for structure for releasably interengaging them in mouth-to-mouth relationship.

12 Claims, 1 Drawing Sheet

DEBRIS COLLECTION AND DISPOSAL SYSTEM AND METHOD

BACKGROUND OF THE INVENTION

It is now common practice to dispose of leaves and other lawn debris by depositing it into disposable "lawn bags" made of plastic films. Loading of such bags is however inconvenient and difficult, because they are not free-standing and are incapable of maintaining an open-mouth configuration. Stands of various kinds have been proposed and provided by which such plastic bags may be supported to assist in loading, but such devices tend to be somewhat inconvenient to use, and they represent an added expense.

Accordingly, the broad objects of the present invention are to provide a system and method for the ready collection and disposal of lawn debris.

A more specific object of the invention to provide such a system which is very simple, is convenient and facile to use, and can be provided to the consumer at virtually no cost beyond that to which he would otherwise be exposed.

Another object of the invention is to provide a bag that is especially well suited for use in such a system.

SUMMARY OF THE INVENTION

It has now been found that certain of the foregoing and related objects of the invention are readily attained by the provision of a system comprising a rigid container and a collapsible container, the two containers having open mouths and having cooperating means thereon for disengagably securing them in mouth-to-mouth assembly. The collapsible container is provided with venting means, permitting the ready displacement of air by debris that is transferred thereinto from the rigid container.

In most instances the collapsible container will be a bag made of a plastic film (i.e., a nonporous web of 10-mil or less synthetic resinous material), and the rigid container will be a conventional trash can or barrel, advantageously also of plastic construction. The means for disengagably assembling the containers may desirably take the form of a tie strip encircling the mouth of the collapsible bag for constricting it, and the venting means may simply be an array of appropriately disposed holes or slits, through which air can escape. In preferred embodiments, the openings will be reinforced to prevent tearing of the bag, most desirably by forming thickened annuli about the vent holes.

Other objects of the invention are attained by the provision of a disposable, collapsible bag having the features herein described. Still further objects are attained by the provision of a method for collecting and disposing of debris and the like, using the system of the invention.

DETAILED DESCRIPTION OF THE ILLUSTRATED EMBODIMENT

Figure 1:
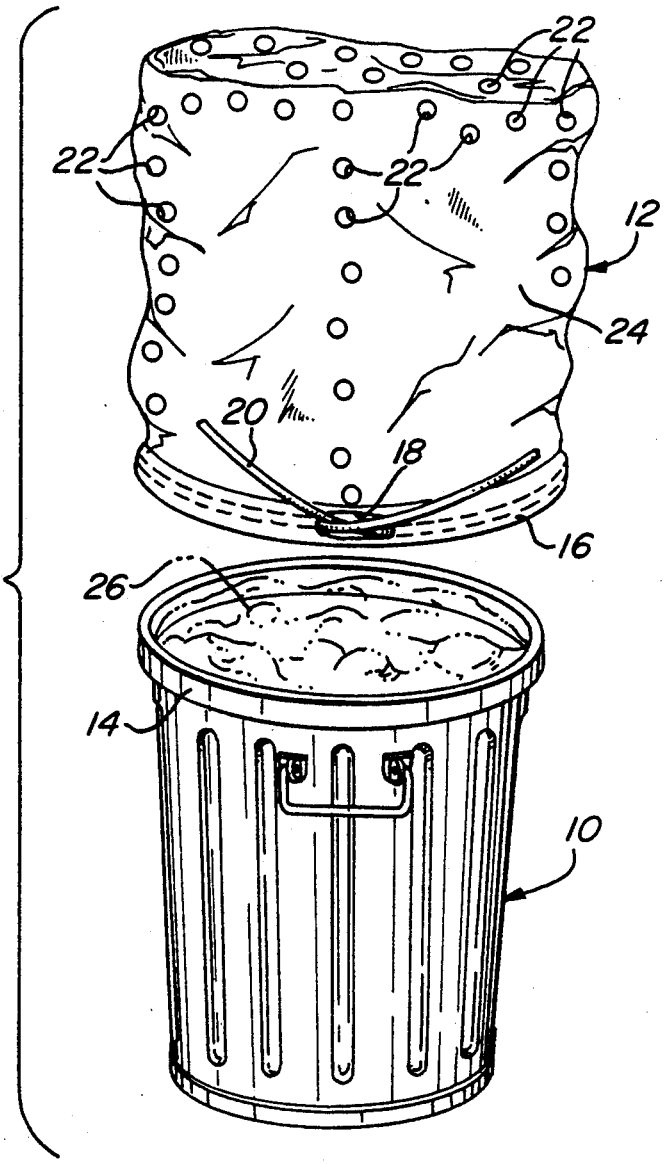
FIG. 1 is an exploded perspective view of a collapsible bag and rigid trash barrel comprising a system embodying the invention.

Turning now in detail to FIG. 1 of the appended drawing, therein illustrated is a collection and disposal system embodying the present invention, and consisting of a rigid trash barrel, generally designated by the numeral 10, and a collapsible, disposable plastic lawn bag, generally designated by the numeral 12. The barrel 10 is of conventional form, and includes an enlarged rim or flange 14 circumscribing and defining its mouth.

The plastic bag 12 is also of substantially conventional construction, and has a sleeve 16 surrounding its mouth, which is conveniently produced by folding back the marginal portion of the bag and securing it along the edge (as by heat-sealing) to create a channel 18. A long, thin strip 20 of material (typically also of plastic) is threaded through the channel 18 for constricting the bag opening, and an array of small holes 22 perforate the body 24 of the bag 12, and serve as venting means.

It will be evident that the system of the invention is employed by first filling the trash barrel 10 with debris 26 (shown in phantom line), as is readily and conveniently done because of its free-standing, self-supporting and highly portable character. When the barrel is filled sufficiently, the open end of the bag 12 is simply slid down over it, far enough to bring the sleeve 16 past the lower edge of the barrel rim 14. Pulling the tie strip 20 tight against the barrel, and securing it by tying together its loose ends, will sufficiently interengage the components to permit transfer of the debris 26 into the bag 12. This is of course accomplished by simply turning the barrel upside down to cause the debris to fall into the bag 12, with the air that would otherwise inhibit the transfer being discharged through the vent openings 22. The strip 20 is then untied to allow separation of the components, and may thereafter be retied to close the bag for movement to a pick-up site.

Apart from use in the system of the invention, the collapsible container described herein is, per se, believed to be structurally and functionally unique. In many instances, simply loading debris into standard, disposable, plastic lawn bags is difficult (even when adequately supported) due to resistance presented by trapped air. The vent means of the instant bag obviates that problem. Similarly, some individuals might prefer to line a rigid barrel with a disposable plastic bag prior to loading, with the bag ultimately being closed and removed for disposal. Here again, the venting of the bag provided for herein facilitates its insertion into, and removal from, the barrel.

Figure 2:
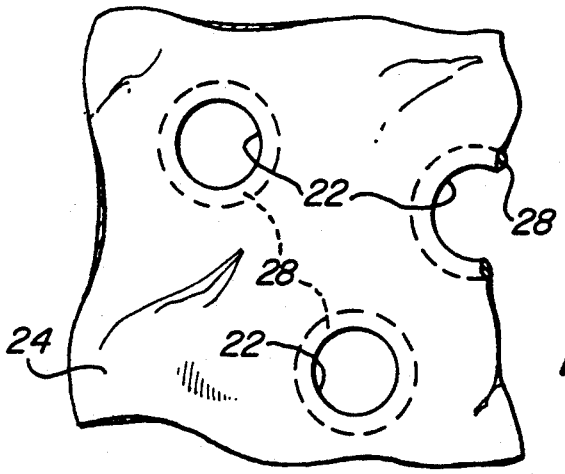
FIG. 2 is a fragmentary plan view, drawn to a greatly enlarged scale, showing a section of the collapsible bag shown in FIG. 1.

While simple punched holes or cut slits may serve as the venting means, it is most desirable that reinforcement be provided to prevent weakening and tearing of the bag, as by forming a thickened annulus about each hole. Such annuli 28, shown in FIG. 2, may inherently be produced from fused resin by using a heated pin to form holes in a thermoplastic film.

It is evident that the barrel 10 and the bag 12 may take a wide variety of forms, differing considerably from those of the illustrated embodiment. Also, the materials from which they are fabricated need not of course be plastics, albeit that bags and barrels so made may be most advantageous from utilitarian and economic standpoints; the barrel may for example be made of metal, and the collapsible bag may be made of a fabric, of paper, or of a laminate or composite material that may contain reinforcing filaments. Finally, the means by which the bag and barrel are engaged with one another may take any of numerous forms, varying from as simple an arrangement as would be afforded by a tight frictional fit, to the level of complexity represented by clamps and encircling bands disposed adjacent the mouth of the rigid container; needless to say, the more positive means of interengagement will be preferred in most instances.

Thus, it can be seen that the present invention provides a system and method for the ready collection and disposal of lawn debris, which system is very simple, is convenient and facile to use, and can be provided to the consumer at virtually no expense beyond that to which he would otherwise be exposed, since lawn bags and trash barrels are normally needed in any event. The invention also provides a bag that is especially well suited for use in the system hereof, as well as for other purposes.

Having thus described the invention, what is claimed is:

1. A system for the collection and disposal of lawn debris and the like, comprising a rigid, free-standing, self-supporting, portable container and a collapsible container, said containers having open mouths dimensioned and configured for mated interengagement, and having cooperating means thereon for disengagably securing them in mouth-to-mouth assembly, said collapsible container having venting means therein for permitting the displacement of air by debris, transferred thereinto from said rigid container, with said containers so secured.

2. The system of claim 1 wherein said rigid container is a trash barrel and said collapsible container is a disposable bag.

3. The system of claim 2 wherein both of said containers are fabricated from synthetic resinous materials.

4. The system of claim 1 wherein said rigid container has an enlarged structural portion adjacent its mouth for mechanically interfering with a portion adjacent said mouth of said collapsible container, and wherein said collapsible container has means adjacent its mouth for constricting the opening thereinto so as to cause the portion of said container thereat to so interfere with said structural portion of said rigid container, and to thereby prevent inadvertent assembly of said container.

5. The system of claim 4 wherein said means on said collapsible container is a strip of material attached to said portion of said collapsible container, said strip having loose ends that can be tied so as to maintain said collapsible container mouth opening in constricted condition.

6. The system of claim 1 wherein said collapsible container has an array of openings on the body thereof providing said venting means.

7. The system of claim 6 wherein said collapsible container is a bag made of a thermoplastic film.

8. The system of claim 7 wherein said venting means comprises an array of openings in the body of said bag.

9. The system of claim 8 wherein said vent openings are reinforced, so as to inhibit tearing of said film thereat.

10. The system of claim 9 wherein said vent openings are holes, and wherein said film is thermoformed to provide a thickened annulus surrounding each of said holes, thereby affording reinforcement thereto.

11. A method for the collection and disposal of lawn debris and the like, comprising:

providing a rigid, free-standing, self-supporting, portable container and a collapsible container, said containers having open mouths dimensioned and configured for mated interengagement, and having cooperating means thereon for disengagably securing them in mouth-to-mouth assembly, said collapsible container having venting means therein for permitting the displacement of air by debris, transferred thereinto from said rigid container, with said containers so secured;

at least partially filling said rigid container with debris or the like;

disengagably securing said rigid and collapsible containers in mouth-to-mouth assembly;

inverting said rigid container to transfer the contents thereof to said collapsible container, effecting thereby the discharge of air through said venting means; and disassembling said containers from one another.

12. The method of claim 11 wherein said means for securing comprises means adjacent said mouth of said collapsible container for constricting the opening thereinto, and wherein said method includes the additional step of using said means for constricting to close said opening subsequent to disassembly of said containers.

* * * * *